US007541991B2

(12) United States Patent
Qi et al.

(10) Patent No.: US 7,541,991 B2
(45) **Date of Patent: *Jun. 2, 2009**

(54) ANTENNA WITH NEAR-FIELD RADIATION CONTROL

(75) Inventors: Yihong Qi, Waterloo (CA); Perry Jarmuszewski, Waterloo (CA); Adam D. Stevenson, Waterloo (CA)

(73) Assignee: Research In Motion Limited, Waterloo (CA)

( * ) Notice: Subject to any disclaimer, the term of this patent is extended or adjusted under 35 U.S.C. 154(b) by 4 days.

This patent is subject to a terminal disclaimer.

(21) Appl. No.: 11/774,383

(22) Filed: Jul. 6, 2007

(65) Prior Publication Data

US 2009/0009419 A1 Jan. 8, 2009

Related U.S. Application Data

(63) Continuation of application No. 10/940,869, filed on Sep. 14, 2004, now Pat. No. 7,253,775, which is a continuation of application No. 10/317,659, filed on Dec. 12, 2002, now Pat. No. 6,791,500.

(51) Int. Cl.
*H01Q 1/12* (2006.01)

(52) U.S. Cl. ..... 343/702; 343/803; 343/818

(58) Field of Classification Search ..... 343/702, 343/803, 818

See application file for complete search history.

(56) References Cited

U.S. PATENT DOCUMENTS

| | | | |
|---|---|---|---|
| 3,521,284 | A | 7/1970 | Shelton, Jr. et al. |
| 3,599,214 | A | 8/1971 | Altmayer |
| 3,622,890 | A | 11/1971 | Fujimoto et al. |
| 3,683,376 | A | 8/1972 | Pronovost |
| 4,024,542 | A | 5/1977 | Ikawa et al. |
| 4,403,222 | A | 9/1983 | Bitter, Jr. et al. |
| 4,471,493 | A | 9/1984 | Schober |
| 4,504,834 | A | 3/1985 | Garay et al. |
| 4,543,581 | A | 9/1985 | Nemet |
| 4,571,595 | A | 2/1986 | Phillips et al. |

(Continued)

FOREIGN PATENT DOCUMENTS

| | | |
|---|---|---|
| EP | 0543645 | 5/1993 |

(Continued)

OTHER PUBLICATIONS

Microwave Journal, May 1984, p. 242, advertisement of Solitron/Microwave, XP002032716.

*Primary Examiner*—Tho G Phan
(74) *Attorney, Agent, or Firm*—Jones Day; Krishna K. Pathiyal; Robert C. Liang

(57) ABSTRACT

An antenna and a wireless mobile communication device incorporating the antenna are provided The antenna includes a first conductor section electrically coupled to a first feeding point, a second conductor section electrically coupled to a second feeding point and a near-field radiation control structure adapted to control characteristics of near-field radiation generated by the antenna. Near-field radiation control structures include a parasitic element positioned adjacent the first conductor section and configured to control characteristics of near-field radiation generated by the first conductor section, and a diffuser in the second conductor section configured to diffuse near-field radiation generated by the second conductor section into a plurality of directions.

29 Claims, 4 Drawing Sheets

U.S. PATENT DOCUMENTS

| | | | |
|---|---|---|---|
| 4,584,709 | A | 4/1986 | Kneisel et al. |
| 4,590,614 | A | 5/1986 | Erat |
| 4,730,195 | A | 3/1988 | Phillips et al. |
| 4,839,660 | A | 6/1989 | Hadzoglou |
| 4,847,629 | A | 7/1989 | Shimazaki |
| 4,857,939 | A | 8/1989 | Shimazaki |
| 4,890,114 | A | 12/1989 | Egashira |
| 4,894,663 | A | 1/1990 | Urbish et al. |
| 4,975,711 | A | 12/1990 | Lee |
| 5,030,963 | A | 7/1991 | Tadama |
| 5,138,328 | A | 8/1992 | Zibrik et al. |
| 5,214,434 | A | 5/1993 | Hsu |
| 5,218,370 | A | 6/1993 | Blaese |
| 5,227,804 | A | 7/1993 | Oda |
| 5,245,350 | A | 9/1993 | Sroka |
| 5,257,032 | A | 10/1993 | Diamond et al. |
| 5,347,291 | A | 9/1994 | Moore |
| 5,373,300 | A | 12/1994 | Jenness et al. |
| 5,422,651 | A | 6/1995 | Chang |
| 5,451,965 | A | 9/1995 | Matsumoto |
| 5,451,968 | A | 9/1995 | Emery |
| 5,457,469 | A | 10/1995 | Diamond et al. |
| 5,493,702 | A | 2/1996 | Crowley et al. |
| 5,684,672 | A | 11/1997 | Karidis et al. |
| 5,767,811 | A | 6/1998 | Mandai et al. |
| 5,821,907 | A | 10/1998 | Zhu et al. |
| 5,841,403 | A | 11/1998 | West |
| 5,870,066 | A | 2/1999 | Asakura et al. |
| 5,872,546 | A | 2/1999 | Ihara et al. |
| 5,903,240 | A | 5/1999 | Kawahata et al. |
| 5,966,098 | A | 10/1999 | Qi et al. |
| 5,973,651 | A | 10/1999 | Suesada et al. |
| 5,977,920 | A | 11/1999 | Hung |
| 5,990,838 | A | 11/1999 | Burns et al. |
| 6,028,568 | A | 2/2000 | Asakura et al. |
| 6,031,505 | A | 2/2000 | Qi et al. |
| 6,140,146 | A | 10/2000 | Brady et al. |
| 6,249,227 | B1 | 6/2001 | Brady et al. |
| 6,329,951 | B1 | 12/2001 | Wen et al. |
| 6,337,667 | B1 | 1/2002 | Ayala et al. |
| 6,515,634 | B2 | 2/2003 | Desclos et al. |
| 6,664,930 | B2 | 12/2003 | Wen et al. |
| 6,677,907 | B2 | 1/2004 | Shoji et al. |
| 6,781,548 | B2 | 8/2004 | Wen et al. |
| 6,791,500 | B2 | 9/2004 | Qi et al. |
| 6,950,071 | B2 | 9/2005 | Wen et al. |
| 6,980,173 | B2 | 12/2005 | Man et al. |
| 7,253,775 | B2 * | 8/2007 | Qi et al. ..... 343/702 |

FOREIGN PATENT DOCUMENTS

| | | |
|---|---|---|
| EP | 0571124 | 11/1993 |
| EP | 0765001 | 3/1997 |
| EP | 0814536 | 12/1997 |
| EP | 0892459 | 1/1999 |
| GB | 2330951 | 5/1999 |
| JP | 55147806 | 11/1980 |
| JP | 05007109 | 1/1993 |
| JP | 5129816 | 5/1993 |
| JP | 5267916 | 10/1993 |
| JP | 05347507 | 12/1993 |
| JP | 6204908 | 7/1994 |
| WO | 9638881 | 12/1996 |
| WO | 9733338 | 12/1997 |
| WO | 9812771 | 3/1998 |
| WO | 9903166 | 1/1999 |
| WO | 9925042 | 5/1999 |
| WO | 0001028 | 1/2000 |
| WO | 0178192 | 10/2001 |

* cited by examiner

ANTENNA WITH NEAR-FIELD RADIATION CONTROL

CROSS-REFERENCE TO RELATED APPLICATIONS

This application is a continuation of U.S. application Ser. No. 10/940,869 filed Sep. 14, 2004 now U.S. Pat. Ser. No. 7,253,775, which is a continuation of U.S. application Ser. No. 10/317,659 filed Dec. 12, 2002, now U.S. Pat. No. 6,791,500.

FIELD OF THE INVENTION

This invention relates generally to the field of antennas. More specifically, an antenna is provided that is particularly well-suited for use in wireless mobile communication devices, generally referred to herein as "mobile devices", such as Personal Digital Assistants, cellular telephones, and wireless two-way email communication devices.

BACKGROUND OF THE INVENTION

Many different types of antenna for mobile devices are known, including helix, "inverted F", folded dipole, and retractable antenna structures. Helix and retractable antennas are typically installed outside of a mobile device, and inverted F and folded dipole antennas are typically embedded inside of a mobile device case or housing. Generally, embedded antennas are preferred over external antennas for mobile devices for mechanical and ergonomic reasons. Embedded antennas are protected by the mobile device case or housing and therefore tend to be more durable than external antennas. Although external antennas may physically interfere with the surroundings of a mobile device and make a mobile device difficult to use, particularly in limited-space environments, embedded antennas present fewer such challenges. However, established standards and limitations on near-field radon tend to be more difficult to satisfy for embedded antennas without significantly degrading antenna performance.

SUMMARY

According to an aspect of the invention, an antenna comprises a first conductor section electrically coupled to a first feeding point, a second conductor section electrically coupled to a second feeding point, and a near-field radiation control structure adapted to control characteristics of near-field radiation generated by the antenna.

In accordance with another aspect of the invention, a wireless mobile communication device comprises a receiver configured to receive communication signals, a transmitter configured to transit communication signals, and an antenna having a first feeding point and a second feeding point connected to the receiver and the transmitter. The antenna comprises a first conductor section connected to the first feeding point a parasitic element positioned adjacent the first conductor section and configured to control characteristics of near-field radiation generated by the first conductor section, and a second conductor section connected to the second feeding point and comprising a diffuser configured to diffuse near-field radiation into a plurality of directions.

Further features and aspects of the invention will be described or will become apparent in the course of the following detailed description.

DETAILED DESCRIPTION

Figure 1:
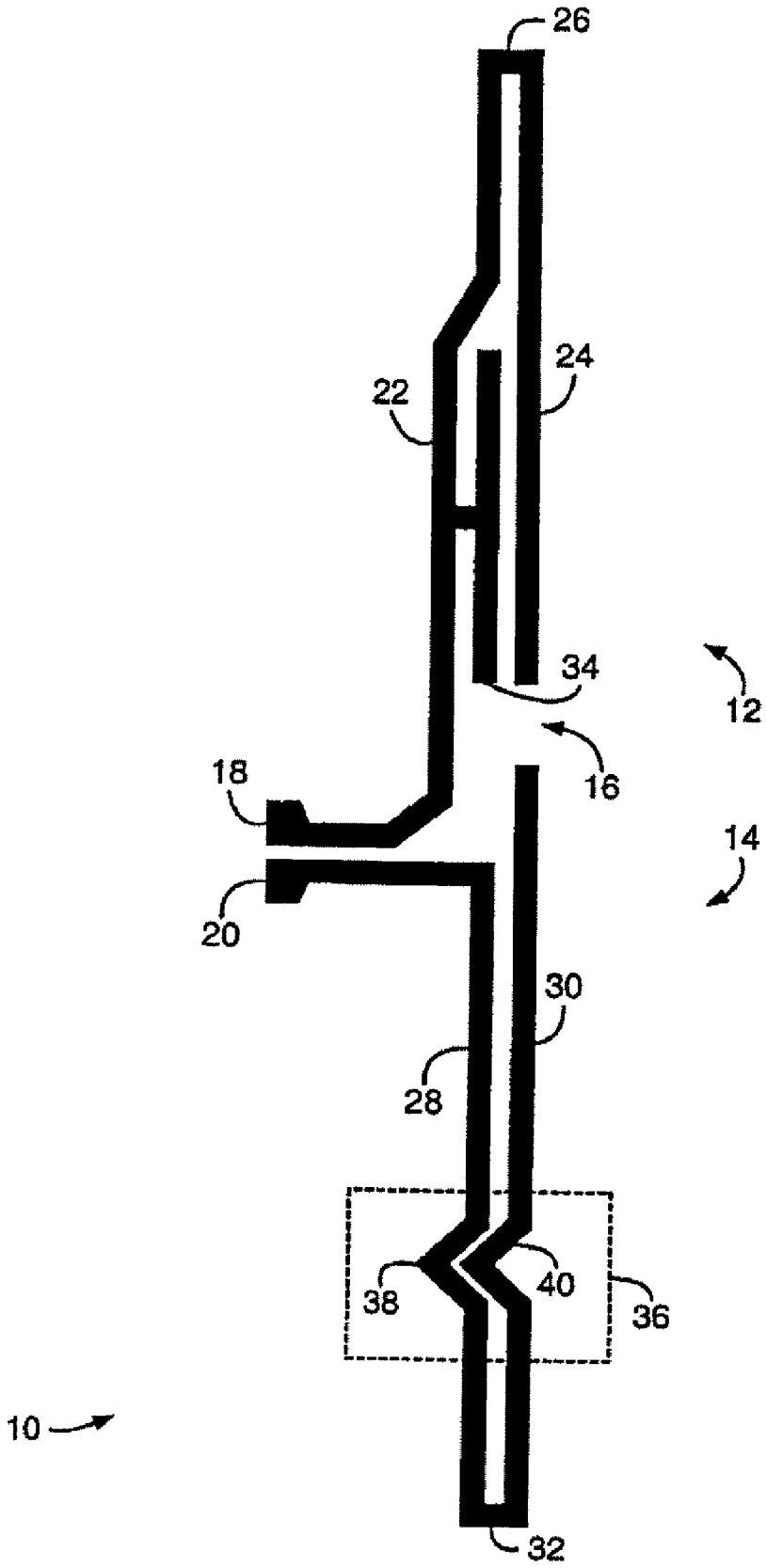
FIG. 1 is a top view of an antenna according to a first embodiment of the invention.

FIG. 1 is a top view of an antenna according to a first embodiment of the invention. The antenna 10 includes a first conduct section 12 and a second conductor section 14. The first and second conductor sections 12 and 14 are positioned to define a gap 16, thus forming an open-loop structure known as an open folded dipole antenna.

Figure 4:
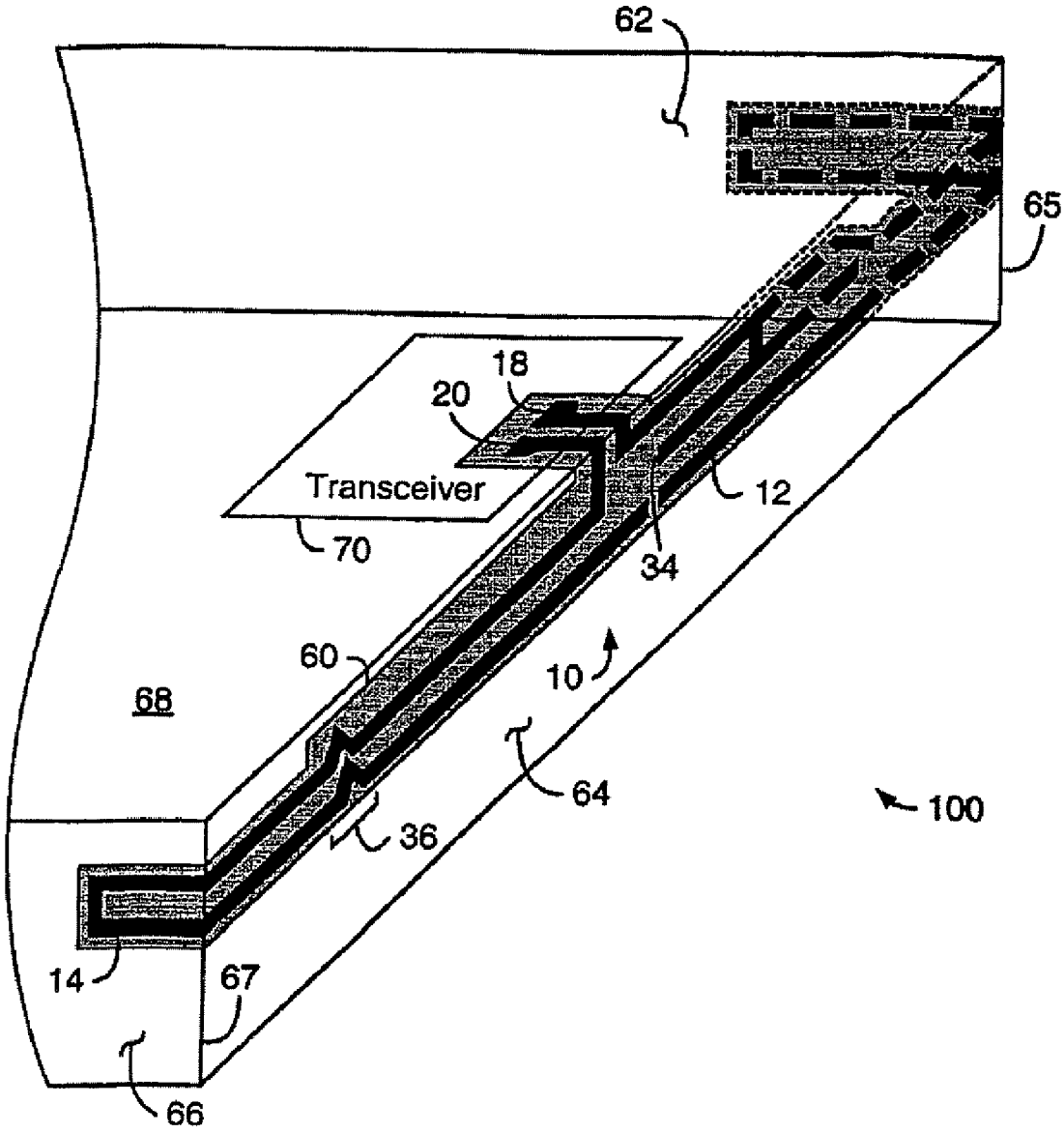
FIG. 4 is an orthogonal view of the antenna shown in FIG. 1 mounted in a mobile device.

The antenna 10 also includes two feeding points 18 and 20, one connected to the first conductor section 12 and the other connected to the second conductor section 14. The feeding points 18 and 20 are offset from the gap 16 between the conductor sections 12 and 14, resulting in a structure commonly referred to as an "offset feed" open folded dipole antenna. The feeding points 18 and 20 are configured to couple the antenna 10 to communications circuitry. For example, the feeding points 18 and 20 couple the antenna 10 to a transceiver in a mobile device, as illustrated in FIG. 4 and described below.

Operating frequency of the antenna 10 is determined by the electrical length of the first conductor section 12, the second conductor section 14, and the position of the gap 16 relative to the feeding points 18 and 20. For example, dereasing the electrical length of the first conductor section 12 and the second conductor section 14 increases the operating frequency band of the antenna 10. Although the conductor sections 12 and 14 are electromagnetically coupled through the gap 16, the first conductor section 12 is the main radiator of the antenna 10.

As those familiar with antenna design will appreciate, the second conductor section 14 in the folded dipole antenna 10 is provided primarily to improve the efficiency of the antenna 10. Environments in which antennas are implemented are typically complicated. The second conductor section 14 significantly increases the overall size of the antenna 10 and thus reduces the antenna dependency on its surrounding environment, which improves antenna efficiency.

Operation of an offset feed open folded dipole antenna is well known to those skilled in the art. The conductor sections 12 and 14 are folded so that directional components of far-field radiation, which enable communications in a wireless communication network, generated by currents in different parts of the conductor sections interfere constructively in at least one of the conductor sections. For example, the first conductor section 12 includes two arms 22 and 24 connected as shown at 26. Current in the first conductor section 12 generates both near- and far-field radiation in each of the arms 22 and 24. The arms 22 and 24 am sized and positioned, by adjusting the location and dimensions of the fold 26, so that the components of the generated far-field radiation constructively interfere, hereby improving the operating characteristics of the antenna 10. The location of the gap 16 in the antenna 10 is adjusted to effectively tune the phase of current in the arms 22 and 24, to thereby improve constructive interference of far-field radiation generated in the first conductor section 12. Since the first conductor section 12 is the primary far-field radiation element in the antenna 10, maintaining the same phase of current in the arms 22 and 24 also improves antenna gain.

The first and second conductor sections 12 and 14 generate not only far-field ration, but also near-field radiation. From an operational standpoint, the far-field radiation is the most important for communication functions. Near-field radiation tends to be confined within a relatively limited range of distance from an antenna, and as such does not significantly contribute to antenna performance in communication networks. As described briefly above, however, mobile devices must also satisfy various standards and regulations relating to near-field radiation.

Although antennas generate near-field radiation in addition to desired far-field radiation, near-field radiation tends to be much more difficult to analyze in antenna design. Far-field radiation patterns and polarizations for many types of antenna are known and predictable, whereas strong near-field radiation effects can be localized in an antenna. Generally, the near-field region of an antenna is proportional to the largest dimension of the antenna. However, simulation and other techniques that are often effective for predicting far-field radiation characteristics of an antenna have proven less reliable for deter near-field radiation patterns and polarizations.

A common scheme for reducing strong near-field radiation to acceptable levels involves installing a shield in a mobile device to at least partially block near-field radiation. Localized shielding required to reduce strong near-field radiation to acceptable levels also have more significant effects on far-field radiation, and thereby degrade the performance of the antenna. In accordance with an aspect of the invention, the antenna 10 includes near-field radiation control structures. These structures, labeled 34 and 36 in FIG. 1, provide another control mechanism for localized near-field radiation.

The structure 34 is a parasitic element comprising a conductor and a connection that electrically couples the conductor to the first conductor section of the antenna 10. The length of the conductor in a parasitic element determines whether the parasitic element is a director or deflector. As those skilled in the art will appreciate, a parasitic deflector deflects near-field radiation. Although the near-field radiation pattern changes with a parasitic director, the direction of energy of such near-field radiation can be enhanced toward the direction of a parasitic director, generally to a greater degree than for a parasitic deflector. Near-field radiation is deflected or directed by the parasitic element 34 to reduce near-field radiation in particular directions.

As described above, near-field radiation tends to be more difficult to predict and analyze than far-field radiation. For far-field radiation, the length of a parasitic element is dependent upon the wavelength of the radiation to be directed or deflected, which is related to the operating frequency band of an antenna. Parasitic elements having a length greater than half the wavelength act as deflectors, and shorter elements act as directors. However near-field radiation characteristics are also affected by mutual coupling between elements of an antenna As such, near-field radiation directors and deflectors in accordance with this aspect of the invention are preferably adjusted as required during an antenna design and testing process in order to achieve the desired effects. When the dimensions and position of a parasitic element have been opitimized for a particular antenna structure, and its effects confirmed by testing and measurement, then the parasitic element is effective for near-field radiation control in other antennas having the same structure.

In a preferred embodiment, the antenna 10 is mounted on the sides of a mobile device housing, with the feeding points 18 and 20 positioned toward a rear of the housing. Since near-field radiation restrictions generally relate to a direction out of the front of such devices, the parasitic element 34 is a deflector in this embodiment of the invention, and deflects near-field radiation toward the rear of the device. Depending upon the desired effect in an antenna, which is often related to the location of the antenna in a mobile device, the parasitic element 34 is configured as either a deflector or a director in alternate embodiments.

The first conductor section 12 is the primary far-field radiating element in the antenna 10. As such, introducing the parasitic element 34 also affects the operating characteristics of the antenna 10. The parasitic element 34, another conductor, electromagnetically couples to both arms 22 and 24 of the first conductor section 12, and, to a lesser degree, to the second conductor section 14. The impact of tie parasitic element 34 on far-field radiation can be minimized, for example, by adjusting the shape and dimensions of the first and second conductor sections 12 and 14, the size of the gap 16, and the offset between the gap 16 and the feeding points 18 and 20. It has also been found by the inventors that the parasitic element 34 can be connected to the first conductor section 12 with relatively little effect on far-field radiation.

The structure 36 in the second conductor section 14 includes a first diffuser 38 in the arm 28 and a second diffuser 40 in the arm 30. Each diffuser 38 and 40 diffuses relatively strong near-field radiation into a plurality of directions. In the absence of the structure 36, the second conductor section 14 genes near-field radiation in a direction substantially perpendicular to the arms 28 and 30. In the above example in which the antenna 10 is mounted along side walls of a mobile device housing with the feeding points 18 and 20 toward the back of the mobile device, this near-field radiation propagates outward from the front of the mobile device. The diffusers 38 and 40 similarly generate near-field radiation, but not in a direction perpendicular to the arms 28 and 30. Instead, the near-field radiation becomes isotropic in nature. The differs 38 and 40 reduce the gain of near-field radiation in a direction perpendicular to the arms 28 and 30. Each diffuser comprises multiple conductor sections which extend in different directions, to thereby diffuse near-field radiation into multiple directions perpendicular to the conductor sections. Those skilled in the art will appreciate that the diffusers 38 and 40 also diffuse far-field radiation. However, the first conductor section 12 is the main radiator of the antenna 10, such that diffusing the far-field radiation generated by the second conductor section 14 does not significantly impact antenna performance.

Figure 2:
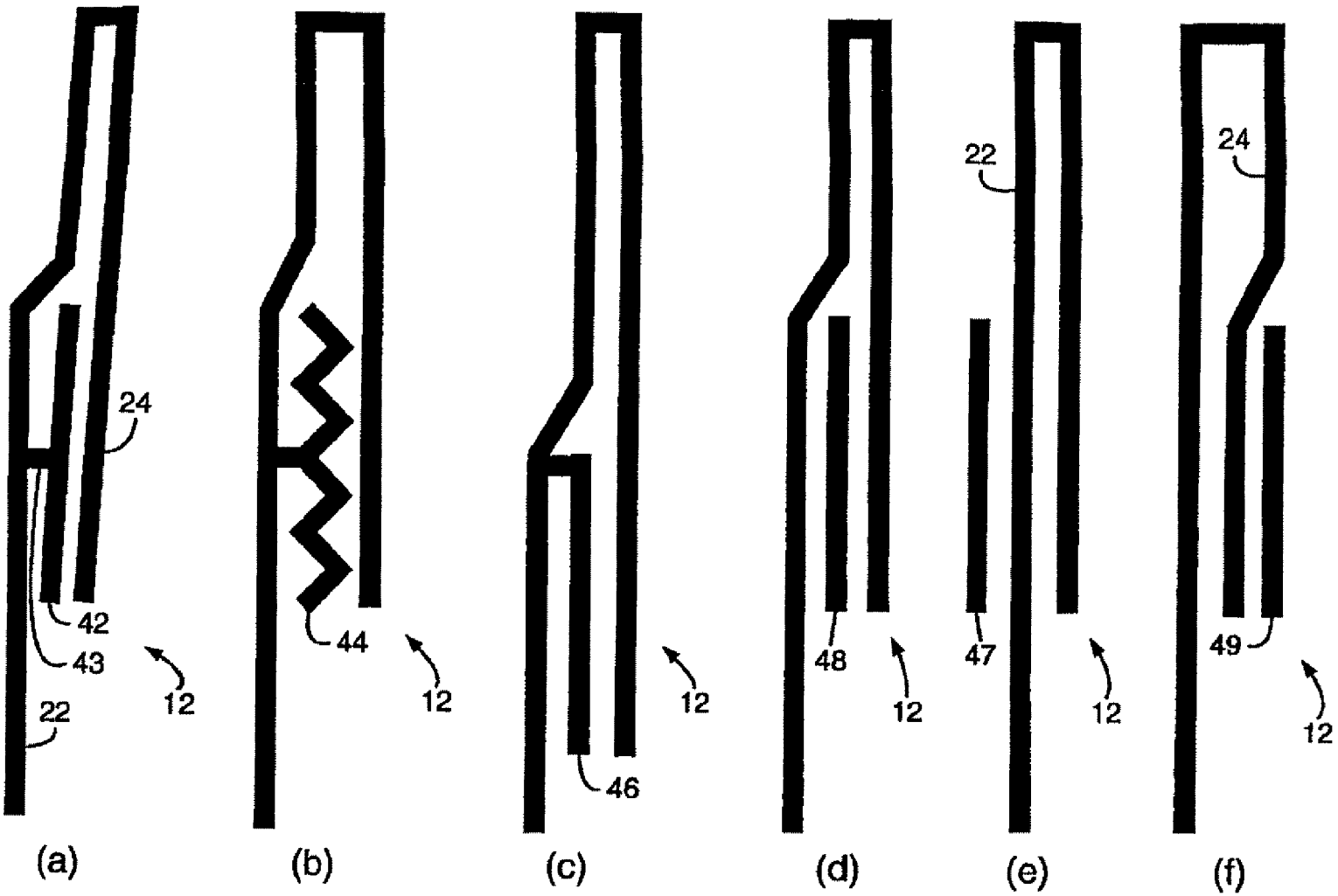
FIGS. 2(*a*)-2(*f*) are top views of alternative parasitic elements.

The antenna 10 shown in FIG. 1 is intended for illustrative purposes. The invention is in no way limited to the particular structures 34 and 36. FIGS. 2(*a*)-2(*f*) are top views of alternative parasitic elements. As described above, a parasitic element is configured as a director or deflector, depending upon its desired effect on near-field radiation The T-shaped parasitic element 42 in FIG. 2(*a*) is substantially the same as the element 34 in FIG. 1, except that the conductor in the parasitic element, that is, the "top" of the T, is not perpendicular to the connection 43 which electrically couples the conductor to the first conductor section 12. In FIG. 2(*a*), the arms 22 and 24 of the conductor section 12 are not parallel, and the conductor in the parasitic element 42 is parallel to the arm 24. Alternatively, the conductor may be parallel to the arm 22, or not parallel to either of the arms, whether or not the arms themselves are parallel to each other.

In a further alternative embodiment, the parasitic element comprises multiple conductor sections, each conductor section being parallel to one of the arms of a folded dipole antenna Thus, the conductor of a parasitic element need not necessarily be straight. For example, the parasitic element 44 comprises a sawtooth-shaped conductor as shown in FIG. 2(*b*).

Not only the shape of a conductor in a parasitic element, but also its connection point to the conductor section 12, can be changed in alternate embodiments of the invention. In FIG. 2(*c*), the parasitic element 46 comprises a conductor which is coupled to the conductor section 12 at one if its ends, to form an L-shaped parasitic element.

As those familiar with antennas appreciate, the conductor in any of the parasitic elements described above electromagnetically couples with other parts of an antenna. Therefore, near-field radiation control using parasitic elements can also be achieved without electrically connecting the conductor in a parasitic element to an antenna Such a parasitic element is shown in FIG. 2(*d*). The parasitic element 48 either directs or deflects near-field radiation into desired directions, preferably away from the front of a mobile device.

The position of a parasitic element relative to the arms of a folded conductor section can also be different in al embodiments. For example, the parasitic element 47 in FIG. 2(*e*) is located at one side of the first conductor section 12 adjacent the arm 22 and the parasitic element 49 in FIG. 2(*f*) is positioned at the other side of the first conductor section 12, adjacent the arm 24, instead of between the arms 22 and 24 as in FIGS. 2(*a*)-2(*d*). Where physical limitations permit, more than one parasitic element may be provided.

Figure 3:
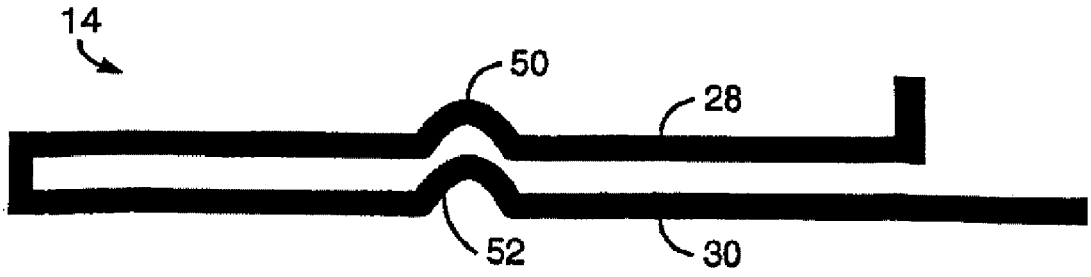
FIG. 3 is a top view of an alternative diffusing element.

Diffusing elements can similarly be implemented having shapes other than the generally V-shaped elements shown in FIG. 1. FIG. 3 is a top view of an alternative diffusing element, comprising a pair of curved diffusers 50 and 52 in the arms 28 and 30 of the second conductor section 14. As described above, a diffuser includes multiple conductor sections extending in different directions to diffuse near-field radiation into directions perpendicular to the conductor sections. Although curved diffusers are shown in FIG. 3, other shapes of diffusers, having straight and/or curved conductor sections, are also contemplated.

FIG. 4 is an orthogonal view of the antenna shown in FIG. 1 mounted in a mobile device. Those skilled in the art will appreciate that a front housing wall and a majority of internal components of the mobile device 100, which would obscure the view of the antenna 10, have not been shown in FIG. 4. En an assembled mobile device, an embedded antenna such as the antenna 10 is not visible.

The mobile device 100 comprises a case or housing having a front wall (not shown), a rear wall 68, a top wall 62, a bottom wall 66, and side walls one of which is shown at 64. The view in FIG. 4 shows the interior of die mobile device housing, looking toward the rear and bottom walls 68 and 66 of the mobile device 100.

The antenna 10 is fabricated on a flexible dielectric substrate 60, with a copper conductor and using known copper etching techniques, for example. This fabrication technique facilitates handling of the antenna 10 before and during installation in the mobile device 100. The antenna 10 and the dielectric substrate 60 are mounted to the inside of the housing of the mobile device 100. The substrate 60 and thus the antenna 10 are folded from an original flat configuration illustrated in FIG. 1, such that they extend around the inside surface of the mobile device housing to orient the antenna 10 in multiple planes. The first conductor section 12 of the antenna 10 is mounted along the side wall 64 of the housing and extends from the side wall 64 around a front corner 65 to the top wall 62. The feeding point 18 is mounted toward the rear wall 68 and connected to the transceiver 70. In this embodiment, the parasitic element 34 is preferably a parasitic defector, to deflect near-field radiation toward the rear wall 68, and thus away from the front of the mobile device 100.

The second conductor section 14 of the antenna 10 is folded and mounted across the side wall 64, around the corner 67, and along the bottom wall 66 of the housing. The feeding point 20 is mounted adjacent the feeding point 18 toward the rear wall 68 and is also connected to the transceiver 70. The structure 36, as described above, diffuses near-field radiation into multiple directions, and thereby reduces the amount of near-field radiation in a direction out of the front of the mobile device 100.

Although FIG. 4 shows the orientation of the antenna 10 within the mobile device 100, it should be appreciated that the antenna 10 may be mounted in different ways, depending upon the type of housing, for example. In a mobile device with substantially continuous top, side, and bottom walls, the antenna 10 may be mounted directly to the housing. Many mobile device housings are fabricated in separate parts that am attached together when internal components of the mobile device have been placed. Often, the housing sections include a font section and a rear section, each including a portion of the top, side and bottom walls of the housing. Unless the portion of the top, side, and bottom walls in the rear housing section is of sufficient size to accommodate the antenna 10 and the substrate 60, then mounting of the antenna 10 direly to the housing might not be practical. In such mobile devices, the antenna 10 is preferably attached to an antenna frame that is integral with or adapted to be mounted inside the mobile device a structural member in the mobile device, or another component of the mobile device. Where the antenna 10 is fabricated on a substrate 60, as shown, mounting or attachment of the antenna 10 is preferably accomplished using an adhesive provided on or applied to the substrate 60, the component to which the antenna 10 is mounted or attached, or both.

The mounting of the antenna 10 as shown in FIG. 4 is intended for illustrative purposes only. The antenna 10 or other similar antenna structures may be mounted on different surfaces of a mobile device or mobile device housing. For example, housing surfaces on Which an antenna is mounted need not necessarily be flat, perpendicular, or any particular shape. An antenna may also extend onto fewer or further surfaces or planes Man the antenna 10 shown in FIG. 4.

The feeding points 18 and 20 of the antenna 10 are coupled to the transceiver 70. The operation of the mobile communication device 100, along with the transceiver 70, is described in more detail below with reference to FIG. 5.

The mobile device 100, in alternative embodiments, is a data communication device, a voice communication device, a dual-mode communication device such as a mobile telephone having data communications functionality, a personal digital assistant (PDA) enabled for wireless communications, a wireless email communication device, or a wireless modem.

Figure 5:
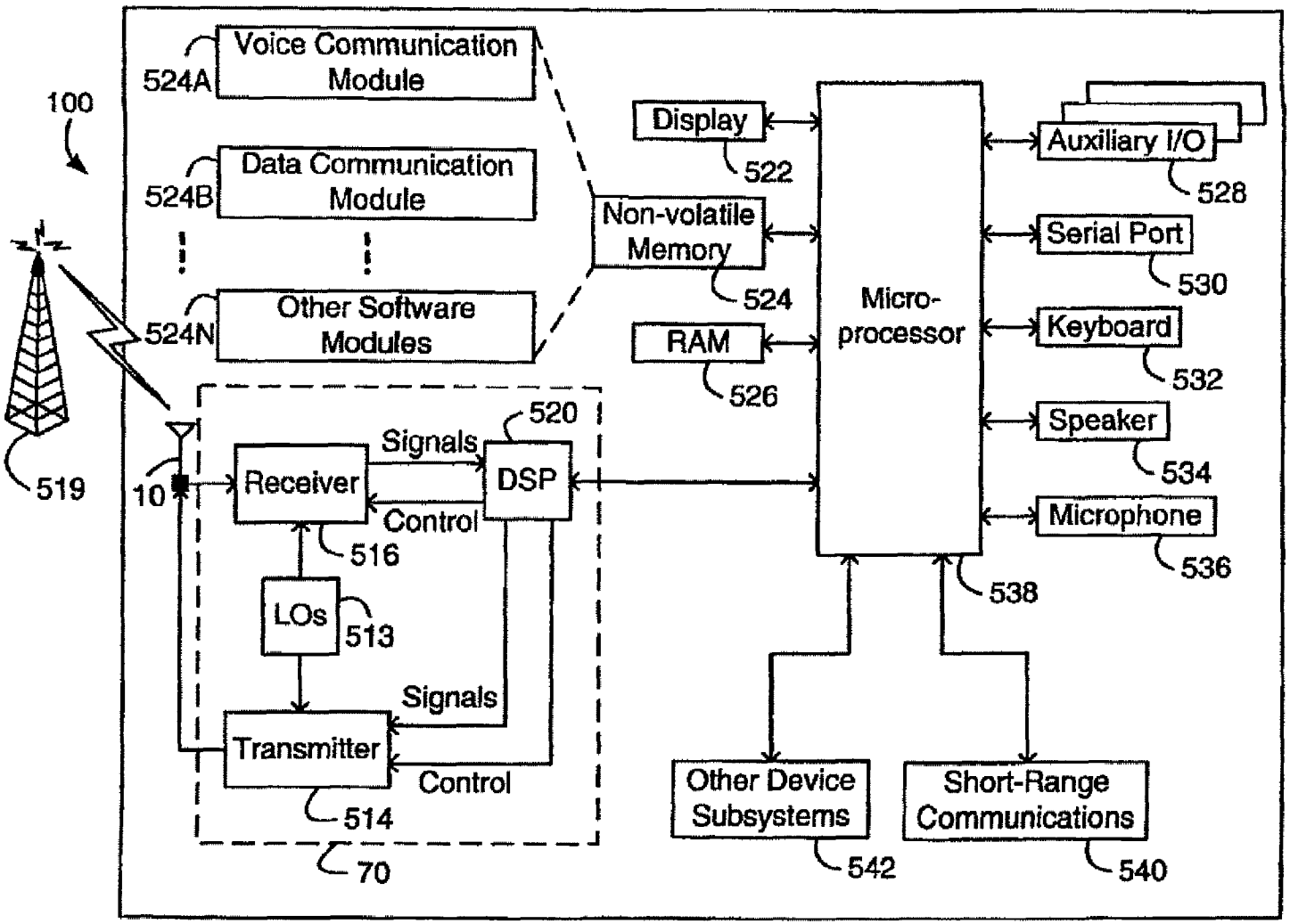
FIG. 5 is a block diagram of a mobile device.

In FIG. 5, the mobile device 100 is a dual-mode and dual-band mobile device and includes a transceiver module 70, a microprocessor 538, a display 522, a non-volatile memory 524, a random access memory (RAM) 526, one or more auxiliary input/output (I/O) devices 528, a serial port 530, a keyboard 532, a speaker 534, a microphone 536, a short-range wireless communications sub-system 540, and other device subsystems 542, Within the non-volatile memory 524, the device 100 preferably includes a plurality of software modules 524A-524N that can be executed by the microprocessor 538 (and/or the DSP 520), including a voice communication module 524A, a data communication module 524B, and a plurality of other operational modules 524N for c g out a plurality of other functions.

The mobile device 100 is preferably a two-way communication device having voice and data communication capabilities. Thus, for example, the mobile device 100 may communicate over a voice network, such as any of the analog or digital cellular networks, and may also communicate over a data network. The voice and data networks are depicted in FIG. 5 by the communication tower 519. These voice and data networks may be separate communication networks using separate infrastructure such as base stations, network controllers, etc., or they may be integrated into a single wireless network.

The transceiver module 70 is used to communicate with the networks 519, and includes a receiver 516, a transmitter 514, one or more local oscillators 513, and a DSP 520. The DSP 520 is used to receive communication signals from the receiver 514 and send communication signals to the transmitter 516, and provides control information to the receiver 514 and the transmitter 516. If the voice and data communications occur at a single frequency, or closely-spaced sets of frequencies, then a single local oscillator 513 may be used in conjunction with the receiver 516 and the transmitter 514. Alternatively, if different frequencies are utilized for voice communications versus data communications for example, then a plurality of local oscillators 513 can be used to generate a plurality of frequencies corresponding to the voice and data networks 519. Information, which includes both voice and data information, is communicated to and from the transceiver module 70 via a link between the DSP 520 and the microprocessor 538.

The detailed design of the transceiver module 70, such as frequency bands, component selection, power level etc., is dependent upon the communication networks 519 in which the mobile device 100 is intended to operate. For example, the transceiver module 70 may be designed to operate with any of a variety of communication network, such as the Mobitex™ or DataTAC™ mobile data communication networks, AMPS, TDMA, CDMA, PCS, and GSM. Other types of data and voice networks, both separate and integrated, may also be utilized where the mobile device 100 includes a corresponding transceiver module 70.

Depending upon the type of network 519, the access requirements for the mobile device 100 may also vary. For example, in the Mobitex and DataTAC data network mobile devices are registered on the network using a unique identification number associated with each mobile device. In GPRS data networks, however, network access is associated with a subscriber or user of a mobile device. A GPRS device typically requires a subscriber identity module ("SIM"), which is required in order to operate a mobile device on a GPRS network Local or non-network communication functions (if any) may be operable, without the SIM device, but a mobile device will be unable to carry out any functions involving communications over the data network 519, other than any legally required operations, such as '911' emergency calling.

After any required network registration or activation procedures have been completed, the mobile device 100 may the send and receive communication signals, including both voice and data signals, over the networks 519. Signals received by the antenna 10 from the communication network 519 are routed to the receiver 516, which provides for signal amplification, frequency down conversion, filtering, channel selection, for example, as well as analog to digital conversion. Analog to digital conversion of the received signal allows more complex communication functions, such as digital demodulation and decoding to be performed using the DSP 520. In a similar manner, signals to be transmitted to the network 519 are processed, including modulation and encoding, for example, by the DSP 520, and are then provided to the transmitter 514 for digital to analog conversion, frequency up conversion, filtering, amplification and transmission to the communication network 519 via the antenna 10.

In addition to processing the communication signals, the DSP 520 also provides for transceiver control. For example, the gain levels applied to communication signals in the receiver 516 and the transmitter 514 may be adaptively controlled rough automatic gain control algorithms implemented in the DSP 520. Other transceiver control algorithms could also be implemented in the DSP 520 in order to provide more sophisticated control of the transceiver module 70.

The microprocessor 538 preferably manages and controls the overall operation of the dual-mode mobile device 100. Many types of microprocessors or microcontroller could be used here, or, alternatively, a single DSP 520 could be used to carry out the functions of the microprocessor 538. Low-level communication functions, including at least data and voice communications, are performed through the DSP 520 in the transceiver module 70. Other, high-level communication applications, such as a voice communication application 524A, and a data communication application 524B may be stored in the non-volatile memory 524 for execution by the microprocessor 538. For example, the voice communication module 524A may provide a high-level user interface operable to transmit and receive voice calls between he mobile device 100 and a plurality of other voice or dual-mode devices via the network 519. Similarly, the data communication module 524B may provide a high-level user interface operable for sending and receiving data, such as e-mail messages, files, organizer information, short text messages, etc., between the mobile device 100 and a plurality of other data devices via the networks 519.

The microprocessor 538 also inters with other device subsystems, such as the display 522, the non-volatile memory 524, the RAM 526, the auxiliary input/output (I/O) subsystem 528, the serial port 530, the keyboard 532, the speaker 534, the microphone 536, the short-range communications subsystem 540, and any other device subsystems generally designated as 542.

Some of the subsystems shown in FIG. 5 perform communication-related functions, whereas other subsystems may provide "resident" or on-device functions. Notably, some subsystems, such as keyboard 532 and display 522 may be used for both communication-related functions, such as entering a text message for transmission over a data communication network, and device-resident functions such as a calculator or task list or other PDA type functions.

Operating system software used by the microprocessor 538 is preferably stored in a persistent store such as non-volatile memory 524. In addition to the operation system, which controls all of the low-level functions of the mobile device 100, the non-volatile memory 524 may include a plurality of high-level software application programs, or modules, such as a voice communication module 524A, a data communication module 524B, an organizer mode (not shown), or any other type of software module 524N. The non-volatile memory 524 also may include a file system for storing data. These modules are executed by the microprocessor 538 and provide a high-level interface between a user and the mobile device 100. This interface typically includes a graphical component provided through the display 522, and an input/output component provided through the auxiliary I/O 528, the keyboard 532, the speaker 534, and the microphone 536. The operating system, specific device applications or modules, or parts thereof, may be temporarily loaded into a volatile store, such as RAM 526 for faster operation. Moreover, received communication signals may also be temporarily stored to RAM 526, before permanently writing them to a file system located in a persistent store such as the non-volatile memory 524. The non-volatile memory 524 may be implemented for example, as a Flash memory component or a battery backed-up RAM.

An exemplary application module 524N that may be loaded onto the mobile device 100 is a personal information manager (PIM) application providing PDA functionality, such as calendar events, appointments, and task items. This module 524N may also interact with the voice communication module 524A for managing phone calls, voice mails, etc., and may also interact with the data communication module for managing e-mail communications and other data transmissions. Alternatively, all of the functionality of the voice communication module 524A and the data communication module 524B may be integrated into the PIM module.

The non-volatile memory 524 preferably provides a file system to facilitate storage of PIM data items on the device. The PIM application preferably includes the ability to send and receive data items, either by itself, or in conjunction with the voice and data communication modules 524A, 524B, via the wireless networks 519. The PIM data items am preferably seamlessly integrated, synchronized and updated, via the wireless networks 519, with a corresponding set of data items stored or associated with a host computer system, thereby creating a mirrored system for data items associated with a particular user.

The mobile device 100 may also be manually synchronized with a host system by placing the device 100 in an interface cradle, which couples the serial port 530 of the mobile device 100 to the serial port of the host system The serial port 530 may also be used to enable a user to set preferences through an external device or software application, or to download other application modules 524N for installation. This wired download path may be used to load an encryption key onto the device, which is a more secure method than exchanging encryption information via the wireless network 519. Interfaces for other wired download paths may be provided in the mobile device 100, in addition to or instead of the serial port 530. For example, a USB port would provide an interface to a similarly equipped personal computer.

Additional application modules 524N may be loaded onto the mobile device 100 through the networks 519, through an auxiliary I/O subsystem 528, through the serial port 530, trough the short-range communications subsystem 540, or through any other suitable subsystem 542, and installed by a user in the non-volatile memory 524 or RAM 526. Such flexibility in application installation increases the functionality of the mobile device 100 and may provide enhanced on-device functions, communication-related functions, or both. For example, secure communication applications enable electronic commerce functions and other such financial transactions to be performed using the mobile device 100.

When the mobile device 100 is operating in a data communication mode, a received signal, such as a text message or a web page download, is processed by the transceiver module 70 and provided to the microprocessor 538, which preferably further processes the received signal for output to the display 522, or, alternatively, to an auxiliary I/O device 528. A user of mobile device 100 may also compose data items, such as email massages, using the keyboard 532, which is preferably a complete alphanumeric keyboard laid out in the QWERTY style, although other styles of complete alphanumeric keyboards such as the known DVORAK style may also be used. User input to the mobile device 100 is further enhanced with a plurality of auxiliary I/O devices 528, which may include a thumbwheel input device, a touchpad, a variety of switches, a rocker input switch, etc. The composed data items input by the user are then stored in the non-volatile memory 524 or the RAM 526 and/or transmitted over the communication network 519 via the transceiver module 70.

When the mobile device 100 is operating in a voice communication mode, the overall operation of the mobile device is substantially similar to the data mode, except that received signals are preferably be output to the speaker 534 and voice signals for transmission are generated by a microphone 536. Alternative voice or audio I/O subsystems, such as a voice message recording subsystem, may also be implemented on the mobile device 100. Although voice or audio signal output is preferably accomplished primarily through the speaker 534, the display 522 may also be used to provide an indication of the identity of a calling party, the duration of a voice call, or other voice call related information. For example, the microprocessor 538, in conjunction with the voice communication module and the operating system software, may detect the caller identification information of an incoming voice call and display it on the display 522.

A short-range communications subsystem 540 is also included in the mobile device 100. For example, the subsystem 540 may include an if device and associated circuit and components, or a short-range RF communication module such as a Bluetooth™ module or an 802.11 module to provide for communication with similarly-enabled system and devices. Those skilled in the art will appreciate that "Bluetooth" and "802.11" refer to sets of specifications, available from the Institute of Electrical and Electronics Engineers, relating to wireless personal area networks and wireless local area networks, respectively.

This written description uses examples to disclose the invention, including the best mode, and also to enable any person skilled in the art to make and use the invention. The invention may include other examples that occur to those skilled in the art.

For example, although described above primarily in the context of a single-band antenna, an antenna with near-field radiation control structures may also include further antenna elements to provide for operation in more man one frequency band.

In alternative embodiments, other antenna designs may be utilized, such as a closed folded dipole structure, for example. Similarly, in an open loop structure, the feeding points 18 and 20 need not necessarily be offset from the gap 16, and may be positioned to provide space for or so as not to physically interfere with other components of a mobile device in which the second antenna element is implemented.

Near-field radiation control structures preferably do not preclude such antenna structures as loading structures and meander structures that are commonly used to control operating characteristics of an antenna. Open folded dipole antennas such as 10 also often include a stability patch on one or both conductor sections, which affects tie electromagnetic coupling between the conductor sections.

We claim:

1. A wireless mobile communication device comprising:

a transmitter;

a receiver; and an antenna having a first feeding point and a second feeding point connected to the transmitter and the receiver, the antenna comprising:

a first conductor section connected to the first feeding point;

a parasitic element positioned adjacent the first conductor section and configured to affect characteristics of near-field radiation generated by the first conductor section; and a second conductor section connected to the second feeding point and comprising a diffuser configured to diffuse near-field radiation into a plurality of directions.

2. The wireless mobile communication device of claim 1 wherein the parasitic element includes a sawtooth-shaped conductor section.

3. The wireless mobile communication device of claim 1 wherein the parasitic element includes a parasitic element conductor section that is substantially parallel to at least a portion of the first conductor section.

4. The wireless mobile communication device of claim 1 wherein the parasitic element includes a parasitic element connection section that electrically couples the parasitic element to the first conductor section.

5. The wireless mobile communication device of claim 4 wherein the parasitic element connection section is substantially perpendicular to a portion of the first conductor section at which the parasitic element connection section attaches.

6. The wireless mobile communication device of claim 5 wherein the parasitic element includes a parasitic element conductor section that is substantially parallel to the portion of the first conductor section at which the parasitic element connection section attaches.

7. The wireless mobile communication device of claim 6 wherein the parasitic element connection section attaches at one end of the parasitic element connection section.

8. The wireless mobile communication device of claim 6 wherein the parasitic element connection section attaches substantially intermediate between the two ends of the parasitic element connection section.

9. The wireless mobile communication device of claim 1 wherein the first conductor section includes a first arm electrically coupled to the first feeding point and a second arm electrically coupled to the first arm.

10. The wireless mobile communication device of claim 9 wherein at least a portion of the first arm is substantially parallel to at least a portion of the second arm.

11. The wireless mobile communication device of claim 10 wherein the parasitic element includes a parasitic element conductor section that is substantially parallel to the portion of the first arm that is substantially parallel to a portion of the second arm.

12. The wireless mobile communication device of claim 9 wherein the parasitic element includes a parasitic element conductor section that is positioned between the first arm and the second arm.

13. The wireless mobile communication device of claim 9 wherein the parasitic element includes a parasitic element conductor section that is positioned adjacent to the first arm.

14. The wireless mobile communication device of claim 9 wherein the parasitic element includes a parasitic element conductor section that is positioned adjacent to the second arm.

15. The wireless mobile communication device of claim 1 wherein the diffuser includes multiple conductor sections extending in different directions.

16. The wireless mobile communication device of claim 15 wherein each of the multiple conductor sections comprises a substantially straight conductor.

17. The wireless mobile communication device of claim 15 wherein the multiple conductor sections comprise curved conductors.

18. The wireless mobile communication device of claim 1 wherein the second conductor section includes a first arm electrically coupled to the second feeding point and a second arm electrically coupled to the first arm.

19. The wireless mobile communication device of claim 18 wherein the first arm comprises a diffuser and the second arm comprises a diffuser.

20. The wireless mobile communication device of claim 19 wherein each of the diffusers includes multiple conductor sections extending in different directions.

21. The wireless mobile communication device of claim 20 wherein each of the multiple conductor sections comprises a substantially straight conductor.

22. The wireless mobile communication device of claim 19 wherein each of the diffusers comprises a curved conductor section.

23. The wireless mobile communication device of claim 1 wherein the first conductor section and the second conductor section are positioned to define a gap therebetween and form an open folded dipole antenna.

24. The wireless mobile communication device of claim 1 further comprising a flexible substrate on which the first conductor section, the second conductor section, the parasitic element, the diffuser, and the first and second feeding points reside.

25. The wireless mobile communication device of claim 24 wherein the flexible substrate is folded to mount the antenna along a plurality of surfaces of the wireless mobile communication device.

26. The wireless mobile communication device of claim 24 wherein the wireless mobile communication device is substantially enclosed within a housing and wherein the antenna is mounted along at least one inside surface of the housing.

27. The wireless mobile communication device of claim 26 wherein the wireless mobile communication device includes an antenna frame, the antenna is mounted to the antenna frame, and the antenna frame is mounted to the housing.

28. The wireless mobile communication device of claim 27 wherein the antenna is mounted to the antenna frame using an adhesive applied to the substrate.

29. The wireless mobile communication device of claim 1 wherein the wireless mobile communication device is selected from the group consisting of data communication devices, voice communication devices, dual-mode communication devices, mobile telephones having data communications functionality, personal digital assistants (PDAs) enabled for wireless communication, wireless email communication devices, and wireless modems.

* * * * *